US005240203A

United States Patent [19]

Myers

[11] Patent Number: 5,240,203

[45] Date of Patent: Aug. 31, 1993

[54] FOLDING WING STRUCTURE WITH A FLEXIBLE COVER

[75] Inventor: Glenn G. Myers, Mission Viejo, Calif.

[73] Assignee: Hughes Missile Systems Company, Tucson, Ariz.

[21] Appl. No.: 103,463

[22] Filed: Oct. 1, 1987

[51] Int. Cl.[5] ..... F42B 10/14

[52] U.S. Cl. ..... 244/3.28; 244/49

[58] Field of Search ..... 244/3.28, 3.3, 49, 3.27, 244/3.26

[56] References Cited

U.S. PATENT DOCUMENTS

| | | | |
|---|---|---|---|
| 1,304,398 | 5/1919 | Sooy | 244/49 |
| 1,339,188 | 5/1920 | Frecska | 244/3.27 |
| 1,358,915 | 11/1920 | Amici | 244/49 |
| 1,373,934 | 4/1921 | Amici | 244/49 |
| 3,826,448 | 7/1974 | Burk, Jr. | 244/49 |
| 4,175,720 | 11/1979 | Craig | 244/3.28 |
| 4,411,398 | 10/1983 | Wedertz et al. | 244/3.28 |
| 4,586,681 | 5/1986 | Wedertz et al. | 244/3.28 |
| 4,667,899 | 5/1987 | Wedertz | 244/3.28 |

FOREIGN PATENT DOCUMENTS 321247 5/1920 Fed. Rep. of Germany ..... 244/49

*Primary Examiner*—Charles T. Jordan

*Attorney, Agent, or Firm*—Charles D. Brown; Randall M. Heald; Wanda Denson-Low

[57] ABSTRACT

A folding wing structure for improved missile aerodynamic performance and manuverability with a minimum payload space requirement which comprises a leading edge spar and at least one trailing edge spar spaced apart from each other by a plurality of transverse ribs, the spars being approximately parallel to each other with the ribs positioned along the spars to divide the structure into a series of parallelograms. The spars and ribs are pivotally joined together with the spars being further pivotally joined to an air frame of an aerodynamic vehicle or missile. In a folded position the spars and rib structure collapse to occupy a minimal amount of volume in a recessed area of the air frame. A spring or piston member secured to at least one, spar forces the spars apart and out from the fuselage to an erected wing position at predetermined sweep angles relative to the fuselage.

12 Claims, 3 Drawing Sheets

FOLDING WING STRUCTURE WITH A FLEXIBLE COVER

BACKGROUND OF THE INVENTION

1. Field of the Invention

This invention relates to folding wing structures and more particularly to a self-erecting, folded wing structure suitable for use on missiles and guided munitions. The invention further relates to high aspect ratio folding wings.

2. BACKGROUND OF THE INVENTION

It has long been understood in the aerospace and munitions arts that wings, stabilizers, and other control surfaces greatly improve missile or projectile performance and maneuverability. These various control surfaces allow for course correction and stabilization which greatly improves accuracy as well as allowing the implementation of highly advanced guidance and target seeking systems.

In many applications, such as aircraft borne missiles, mounting hardware used to support a missile on an aircraft body or wing can account for the volume occupied by wings on the munitions. That is, spacers and support structures position missiles so that their fixed wings clear any adjacent surfaces, However, in many applications, especially in armored vehicle, ship borne, and hand held launching devices, the missile launching mechanisms require the wings to be stowed interior to the missile and erected after launch. This allows for highly compact, simplified launching systems which are better suited to the limited volume or weight available for these applications.

However, it is important that the wings or stabilizers not sacrifice an unduly large amount of volume inside the missile, and not impact on the aerodynamic characteristics of the missile, or create a breach in any hermetic or RF seal provided around interior missile components.

Many self-erecting wings or wing structures have been developed in an attempt to meet these requirements. Many of the wing structures comprise wings that pivot or fold out from a recessed cavity in the side of a missile fuselage or airframe. The wings themselves generally comprise a rib support structure over which an aluminum or similar metallic skin is secured. Therefore, these wings represent "solid" folding wing structures which require a fairly large storage volume at least the size of the fully erected wing.

However, it has also been discovered that the use of flexible cover material, such as a mylar, nylon or graphite reinforced fiber, can decrease weight and bulk while still providing a wing of reasonable strength. A wing utilizing a flexible cover or fabric construction is illustrated in U.S. Pat. No. 4,411,398 issued to Wedertz et al.

In Wedertz et al, a fabric material is stretched between the side of a missile fuselage and a point located some distance out from the fuselage to form an aerodynamic surface. This is accomplished utilizing a series of pivoting arms attached to the missile which form a leading edge spar projecting out from the side of the missile. Fabric is stretched from the fuselage to the outer end of the spar. While this represents decreased volume and weight requirements, there are still several operational drawbacks. This type of wing lacks any type of surface support for the flexible material in order to maintain aerodynamic characteristics of the wing and decrease the effects of turbulence. Also, long leading edge spars must be made from fairly large bulky material to accommodate all of the stress exerted on the wing during flight. In addition, the spar mechanism makes it very difficult to achieve some types of wing structures, most notably a swept design with the wing trailing edge parallel to the leading edge.

Therefore, what is needed is a new type of folding wing design which takes advantage of a lightweight, small volume, flexible cover technique, while achieving surface strength and contour control more typically found in solid wing structures. In addition, it would be useful to achieve a flexible folding wing design which allows improved control over sweep angle configuration and larger aerodynamic spans.

SUMMARY

In view of the above problems and goals, the present invention provides an improved folding wing apparatus for use on missiles and guided munitions. It is an object of the present invention to provide a flexible wing structure having increased surface support for a flexible covering membrane.

It is a purpose of the present invention to provide folding wing apparatus which automatically erects itself to predetermined leading edge angles with respect to a fuselage and has a trailing edge parallel to the leading edge.

It is another purpose of the present invention to provide a folding wing structure utilizing a flexible cover which can have its sweep angle altered after deployment to compensate for changes in a vehicle center of gravity or other flight characteristics.

It is an advantage of the present invention that it provides a collapsible wing structure that permits a greater span and a greater Aspect Ratio wing.

It is another advantage of the present invention that it provides a collapsible wing structure capable of accommodating larger amounts of stress.

It is a further advantage of the present invention that it provides a folding wing using an airfoil configuration for improved vehicle maneuvering and range.

These and other objects, purposes, and advantages are realized in a folding wing structure comprising leading and trailing edge spars pivotally mounted substantially parallel to each other and to an air frame portion of a missile or similar aerodynamic vehicle. The two spars are spaced apart by a distance corresponding to the width of a desired wing surface. A plurality of wing ribs are pivotally mounted between the leading and trailing edge spars in spaced relationship and positioned to be substantially parallel to each other and to form a series of interconnected parallelograms with the spars. The pivot mounting point for the trailing edge spar is preferably positioned further inside of the air frame than the leading edge pivot. The distance by which each of the pivot points for the two spars are spaced inward from the outer surface of the missile, determines the degree to which the wing is recessed from the outer surface in a retracted position.

In a preferred embodiment, a spring means positioned between the leading and trailing edge spars forces the two spars to separate until prevented from doing so by a locking mechanism. This causes the wing to expand outward from a retracted position and erect itself at a predetermined angle. The sweep angle is determined by the locking mechanism which prevents further rotation of the leading and trailing edge spars about their pivotal mounting points. Alternatively, a locking mechanism may prevent further rotation of the spars about their respective pivot points on the ribs.

In a further aspect of the invention, a pneumatic mechanism may be secured between an interior portion of the air frame of a missile and the leading edge spar to press upon and move the leading edge spar outward from the missile air frame. During erection of the wing structure, a flexible cover disposed over the spar and rib structure is formed into a substantially rigid aerodynamic foil shape supported along the leading and trailing edges by the spars and therebetween by the ribs. Airfoil shapes can be achieved using curved rib members to support the flexible cover. High wing loads can be accommodated by the addition of one or more intermediate spars.

Thus, the invention provides a self-erecting, folded wing structure utilizing a flexible cover for use on missiles and airborne munitions to provide increased performance and maneuverability without sacrificing payload space.

BRIEF DESCRIPTION OF THE DRAWINGS

The novel features of the present invention may be better understood from the accompanying description when taken in conjunction with the accompanying drawings in which like characters refer to like parts and in which.

DETAILED DESCRIPTION OF A PREFERRED EMBODIMENT

The present invention comprises a self-erecting folded wing structure using a flexible cover. The folded wing structure comprises a series of support ribs pivotally secured to and interlocking with a leading and trailing edge spar which are pivotally secured to and rotated outward from an air frame of a missile, airborne munition, or similar aerodynamic vehicle. The wing structure is capable of being erected to a variety of predetermined wing sweep angles, as well as modified during flight to account for variations in the air frame aerodynamic characteristics.

Figure 1:
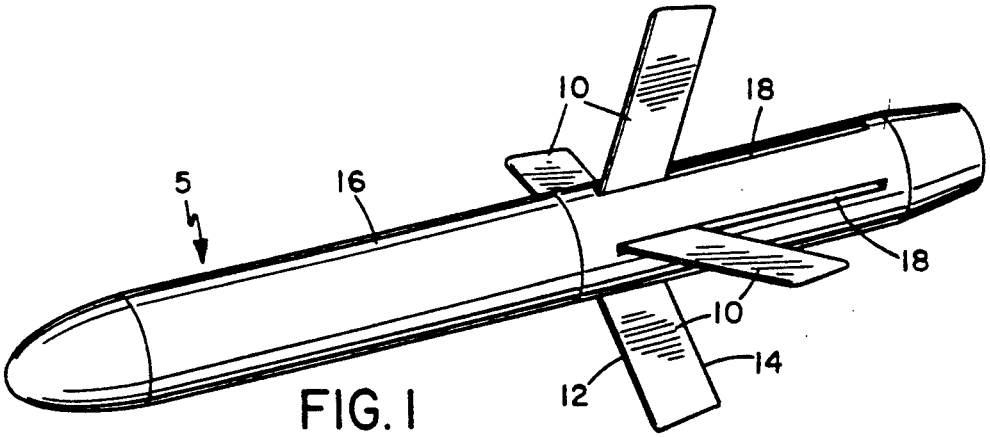
FIG. 1 is a perspective view of a typical missile incorporating folding wings constructed according to the principles of the present invention in a fully extended position.

A folding wing structure constructed according to the principles of the present invention is illustrated in perspective in FIG. 1. In FIG. 1, a missile 5 is shown using four folding wing structures 10 having a leading edge 12 and a trailing edge 14. The folding wing structures 10 are illustrated in a fully extended position having a predetermined sweep angle with respect to the outside housing 16 of the missile 5. In the retracted position, such as during initial launch of the missile 5, the wings 10 would be folded into recesses 18 along the side of the missile 5. The overall size of the recesses 18 depends upon the design thickness and length for the wing structures 10, as well as the volume required by the flexible material disposed over the wing structure.

Figure 2:
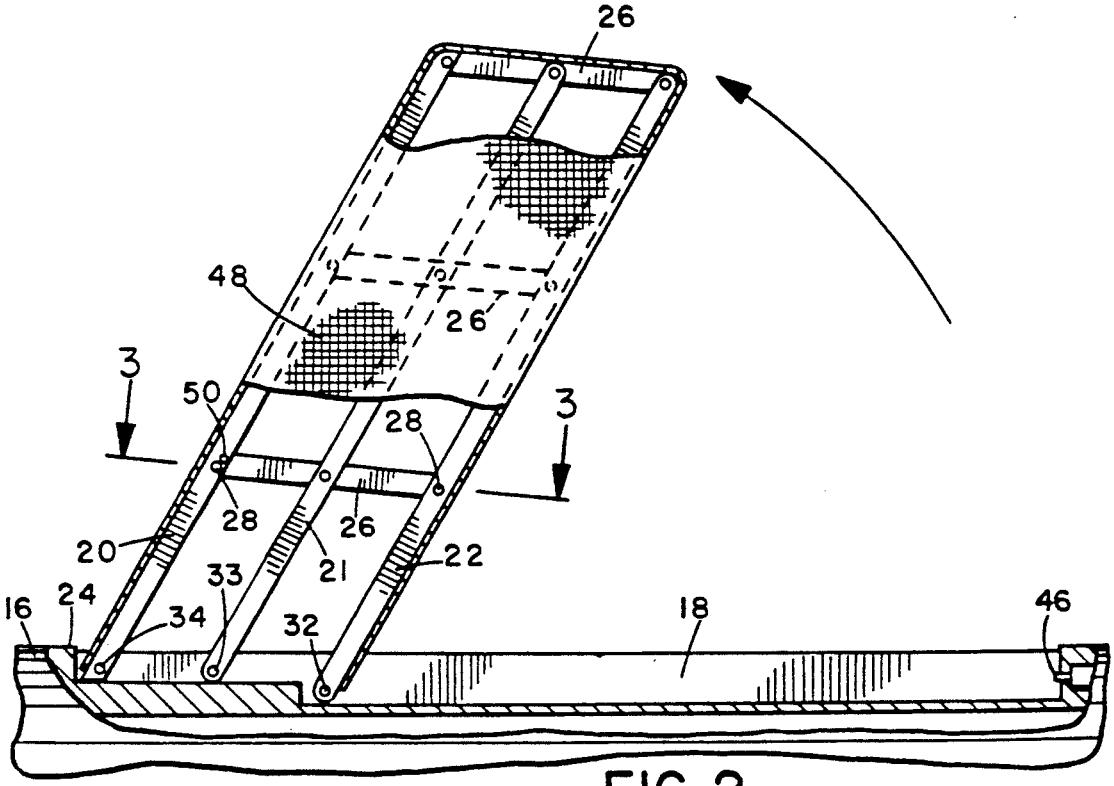
FIG. 2 is an enlarged side elevation view, with portions cut away, showing one wing of FIG. 1 in the extended position.

As shown in more detail in the sectional view of FIG. 2, the wing structure 10 comprises a leading edge spar 20 and a trailing edge spar 22 pivotally mounted to an air frame 24 within the missile housing 16. For distributing or accommodating larger pressure loads or forces on the wing structure 10, one or more intermediate 21 spars can also be employed.

The spars 20 and 22 can comprise several materials such as aluminum, stainless steel, titanium and advanced technology alloys, or plastic composites, with aluminum generally being preferred. The spars can be configured in a variety of solid or tubular shapes, depending upon the specific weight and strength requirements of the vehicle to which they are secured.

Figure 3:
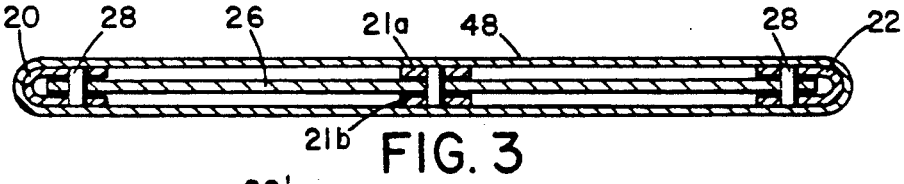
FIG. 3 is an enlarged side sectional view taken on line 3—3 of FIG. 2.

An exemplary embodiment of the wings 10 is illustrated in cross section in FIG. 3 where the leading edge spar 20 has a curved edge facing the forward or leading edge of the wing 10 and the trailing edge spar 22 has a curved edge facing the back or trailing edge of the wing. The spars 20 and 22 generally comprise either hollow tubular or C-shaped channel materials with curved sidewalls. The curvilinear surface of the spars 20 and 22 has an arc or radius determined by the desired wing thickness and lift requirements. Those skilled in the art of aerodynamic vehicle design and operation know the dimensions desired for each vehicle or missile the wing 10 would be applied to. Therefore, the dimensions of the spar 20 and spar 22 are readily apparent from the operational characteristics of the vehicle it is to be applied to. The spars 20 and 22 can also have either circular or more elliptical cross sections depending on the transverse stress or load being distributed by the spars. The hollow or C-shaped tubular members provide structural support without the excess weight of a solid bar of material. As discussed above, additional intermediate spars can be employed when desired, which allows the spars 20 and 22 to remain small and lightweight even for high wing stresses.

By utilizing tube or channel structures the spars may be conveniently manufactured using standard extrusion techniques for aluminum and similar materials. When plastic or graphite composites are used, the spars comprise either a solid body structure built up to the desired shape or a mold form on which a curvilinear structure or support member is formed using known processing techniques for manufacturing articles out of such composites.

The strong lightweight spar structure of the present invention, when combined with the support ribs described below, allows greater Aspect Ratio wings than previous designs. This leads to greater flexibility in missile design or planning mission capabilities.

To provide proper surface support and shape and complete the wing structure, a series of support ribs 26 extend between the spars 20 and 22 or between the spars 20 and 22 and any intermediate spars 21, and are pivotally secured to the spars on each end. The pivot arrangement can comprise a pair of mating holes with a pin 28 inserted therethrough or a more complex arrangement on the order of a bearing and pin assembly. The choice of pivot structure depends upon the degree of tolerance allowed for relative motion of the spar and ribs once the wing is in its fully erected position, and on the force the pivot joint must bear as the parts rotate relative to each other. In some applications a true bearing structure or assembly may be required in place of the simple pin 28 to function efficiently under higher wing load conditions.

The individual support ribs 26 can comprise a variety of tubular or solid bar materials which extend between the two spars 20 and 22. As shown in FIG. 3, one preferred embodiment utilizes a thin bar or plate shaped element 26 which fits within the curved surfaces of the edge spars when the wing 10 is retracted or collapsed. In the alternative, tubular material, square or round, can be used for the ribs 26 provided it is small enough to fit within the interior height of the spars 20 and 22.

Figure 4:
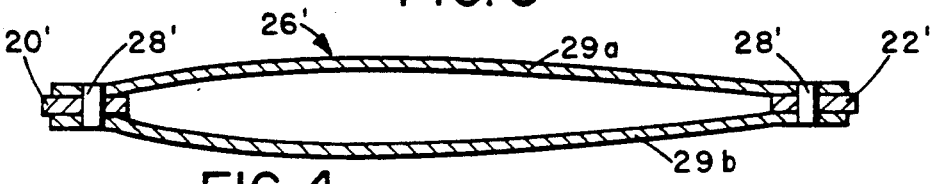
FIG. 4 is a similar sectional view without the flexible cover, showing an alternative frame structure.

FIG. 4 illustrates an alternative wing 10 structure for the spars 20 and 22 and ribs 26. As shown in the sectional view of FIG. 4, the ribs 26' comprise a pair of bar or flat plate elements 29 which are secured on each side of, or the outside of, the spars 20' and 22'. In this embodiment the edge spars 20', and 21, and 22' comprise a flat bar or plate material which can be rounded along outer edges. By using this configuration, flexible material stretched over the folding wing structure 10 is provided with maximum surface support from the ribs 26' while allowing the wing 10 to fully collapse or retract.

For applications where improved aerodynamic guidance surfaces are desired the upper rib piece 29*a* and lower rib piece 29*b* of the support ribs 26' may have a curved contour in order to maintain both sides of the wing in a curved configuration. However, when only two wings are used, it is desirable to configure the upper pieces 29*a* in a longer arc-type curve than the lower pieces 29*b* to form the flexible cover into a more traditional airfoil or lifting wing shape. In the alternative, the rib members 29*a* and 29*b* can comprise a single "I" beam member having a curved upper surface and notched ends for accepting the spars.

This airfoil shape is more efficient in terms of aerodynamic drag and early stall (separated flow) at low angles of attack for the wings 10. A missile or other aerodynamic vehicle using airfoil shapes achieves greater range for given fuel and payload limitations and greater maneuvering capability.

One consideration in choosing a particular structural configuration for joining a support rib 26 and the spars 20, 21 or 22 is the surface uniformity desired for the flexible wing covering material, as well as clearance for pivoting elements. That is, by having the ends of the support ribs 26 insert within or between the walls of the spars 20 and 22, the flexible covering material is going to conform in a more uniform manner across the leading and trailing edges, therefore, forming a more perfect aerodynamic shape. This configuration also requires, however, that the support ribs 26 fit within the spars to pivot freely inside the spars from the totally collapsed to totally erected positions of the wing structure 10.

Returning now to FIG. 2, one support rib 26 occupies a position adjacent to and bridging between the outermost ends of the spars 20 and 22. This particular rib can be configured to have a sloped or rounded outer edge that forms the tip of the wing structure 10 when covered with flexible material. This rib may comprise curved material similar to the spars 20 and 22.

The opposite ends of the spars 20 and 22 are secured to pivotal mounting means on the air frame 24 of the missile 5 interior to the outer housing 16. A forward pivot mount 30 secures the leading edge spar in place on the air frame 24 while a back pivot mount 32 secures the trailing edge spar in place on the air frame 24. The pivot mount 32 generally needs to be located farther to the interior of the missile housing 16 than the pivot mount 30 in order to position a majority or all, depending on the application, of folding wing structure 10 interior of the housing 16 in its fully collapsed or retracted position. The closer the pivot mount 32 is to being the same distance from the outer housing wall of the missile as the pivot mount 30, then the larger the percentage of the wing structure 10 that resides outside of an imaginary line connecting the two pivot mounts. The more structure above this line, then the deeper the recesses 18 must to hold the wing structure in the housing when collapsed. Since it is desirable in most applications to have the wing structure 10 completely inside the outer housing 16 in order to maintain an ideal air foil or air flow configuration, and use as shallow a recess 18 as possible, the pivot mount 32 is moved a substantial distance interior of the outer housing 16 on the air frame 24 relative to the pivot mount 30. At the same time, a pivot mount 33 used for intermediate spars 21 would fall on an imaginary line extending between the pivot mounts 32 and 34 to provide the benefits described above.

The pivot mounts 30 and 32 comprise one of several structures available for holding a tubular or curved surface spar adjacent to an air frame while allowing motion about a fixed point. An exemplary mount is a pivot arm or bracket extending from a portion of the air frame which is thinner than the inside height of the spars. The arm has a passage in a central location for receiving a pin 34 which extends through the pivot arm and the ends of the spar. To increase structural tolerances and decrease binding the pivot arm passage can have a commonly known bearing assembly disposed in the pin passage for engaging the pin in a rotatable joint. Alternately, a series of pivot arms can be positioned on each side of the spar end portion with a pin through the spar.

The construction of pivotal mounting joints is well understood in the mechanical arts. Therefore, these joints are not described in further detail here.

The ribs 26 or 26' are secured between the spars 20 and 22 so that they are substantially parallel to a line extending between the center of the pivot mounts 30 and 32. This provides a series of parallelogram structures along the length of the wing, giving the wing strength while creating an easily collapsed or erected support structure.

Figure 5:
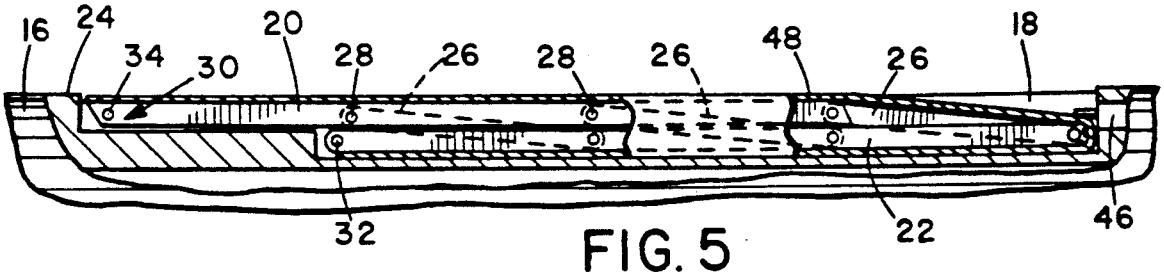
FIG. 5 is a view similar to FIG. 2, showing the wing in a retracted position.

A substantially collapsed or retracted folding wing structure 10 is illustrated in FIG. 5. In FIG. 5, the spars 20 and 22 have been rotated about the pivot mounts or points 30 and 32 until they are substantially parallel to the outer housing 16 of the missile 5. At the same time the ribs 26 rotate about the respective pivot points where they are secured to the spars 20 and 22 to also align themselves with and adjacent to the side of the missile 5. As shown in FIG. 5, the ribs 26 fold into the edge spars 20 and 22 (or over in the case of ribs 26') in order to allow the edge spars to fold adjacent to each other and into the recess 18. As will be apparent to those skilled in the art, the dimensions of the edge spars 20 and 22 and the flexible cover, when folded, determine the minimum dimensions desired for the recesses 18.

Figure 6:
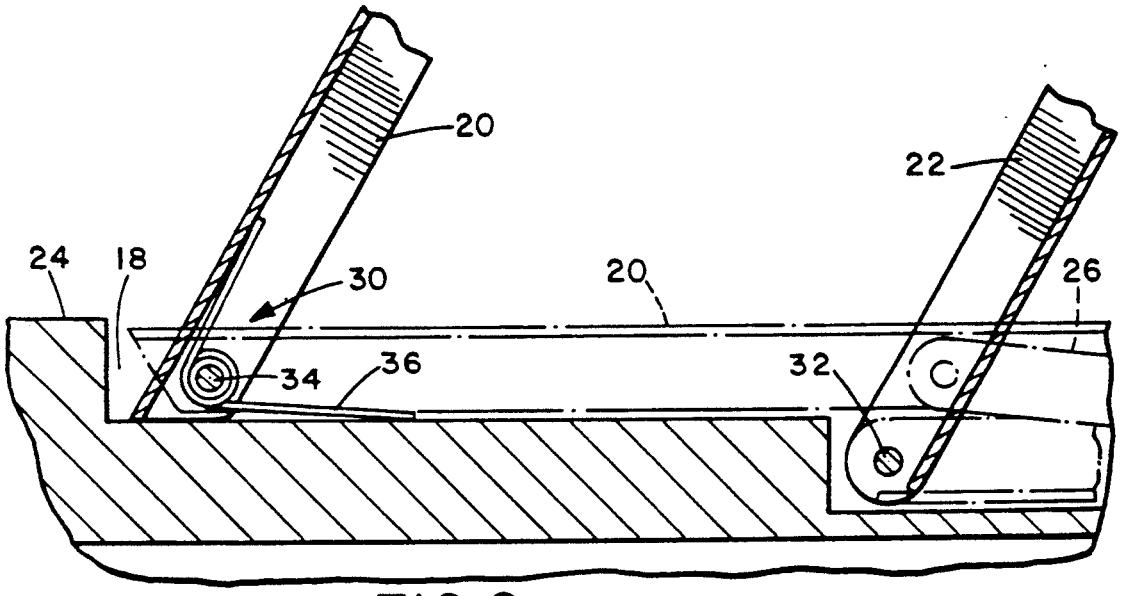
FIG. 6 is an enlargement of a portion of FIG. 5, showing one method of extending the wing.

The folding wing structure 10 is moved between its collapsed and erected position utilizing one of several techniques. This can be accomplished as illustrated in FIG. 6 by utilizing a spring assembly 36 which comprises several types of springs such as leaf or coil springs secured between the air frame 24 near or around the pivot 30 and the spar 20. These types of spring combinations are well known in the mechanical arts and are not described in further detail here. A spring assembly can also be employed on the spar 22 and pivot mount 32 if desired. The pressure from the spring 36 forces the spar 20 to move away from the air frame 24 which forces the spars 20 and 22 apart.

Forcing the spars 20 and 22 to move apart, causes them to pivot freely about the pivot mounts 30 and 32 until they reach a desired sweep angle and are locked in place. The maximum separation of spars 20 and 22 occurs when the support ribs 24 are at an approximate 90 degree angle with respect to the spars. However, since this places the wing at a 90 degree sweep angle with respect to the side of missile 5, a locking mechanism is generally used to place the wing assembly 10 in an alternate sweep angle. It is an advantage of the present invention that sweep angles less than 90 degrees are easily achieved with a very strong and rigid wing structure.

Figure 8:
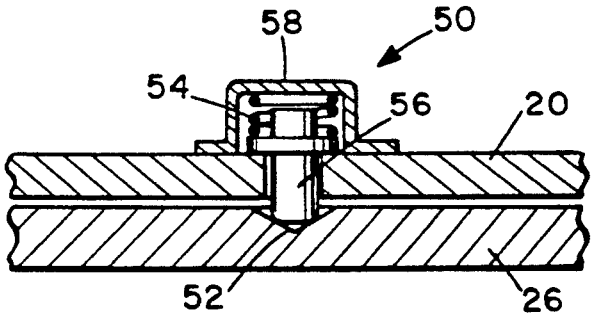
FIG. 8 is a sectional view of a detent and stop mechanism used in the wing of FIG. 1.

The locking mechanism can comprise many mechanical stopping devices such as a detent and snap pin structure 50 located adjacent to or incorporated as part of any of the pivoting mounts. As shown further in FIG. 8, the structure 50 comprises a detent or aperture 52 disposed on one of the ribs (or spars in alternate configuration) and a spring 54 actuated pin 56 mounted in a housing 58 on a spar, here 20. The pin is forced into the detent 52 when the spar rotates and positions the detent 52 under the pin 56. In the alternative, a cable or sweep angle strut, not shown, is attached to the leading edge spar 20 and extends back into the housing 16 of the missile 5. The cable has a predetermined length and is secured to the leading edge spar 20 so that it prevents movement beyond a predetermined, desired sweep angle.

Figure 7:
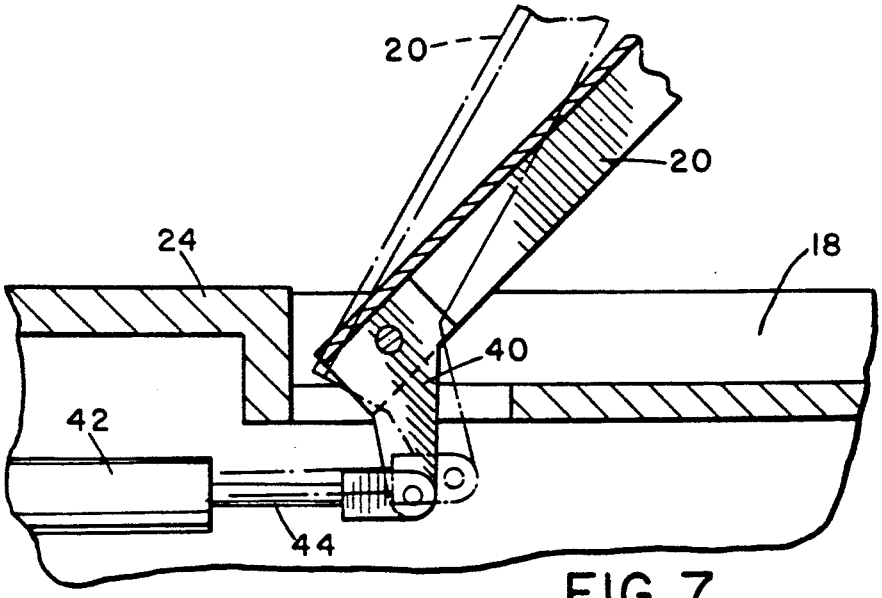
FIG. 7 is a similar view showing alternative extension means for variable sweep angle control.

An alternative method on controlling the sweep angle is illustrated in FIG. 7. In FIG. 7, a control lever 40 is attached to a moveable and remotely actuated drive mechanism 42 using a control rod 44. The drive mechanism 42 can comprise several drivers known in the art such as a hydraulic piston operating from other hydraulic lines or an electrical step motor or geared piston. This configuration allows the sweep angle to be altered during flight in response to control signals indicative of varying flight conditions. This allows the guidance system to also detect variations in the aerodynamic characteristics of the missile, such as center of gravity shift due to spent fuel, and alter the sweep angle. The present invention, therefore, provides control over sweep angle and the Aspect Ratio of the wing not previously achieved for small missiles.

The folding wing structure 10 is covered by a flexible, fabric-like material 48 which forms the actual air foil surface. The covering material can comprise any number of materials that are available for use on aerodynamic vehicles such as, but not limited to, cotton fabric, polyester sheeting, rayon or other synthetic reinforced fabrics, or special materials such as Kevlar. The specific choice of fabric material depends upon the design limitations and applications for the missile or airborne munition. Those skilled in the art have predetermined mission criteria upon which material choices are based.

Generally to deploy or prevent deployment a small retractable bolt assembly 46 is used. This assembly can be pneumatically or electrically actuated once the missile has cleared any launching assembly. A preferred embodiment is to use a small explosive bolt for the assembly 46 which is detonated by a sensor after the missile 5 leaves the confines of a launcher or any adjacent mounting structure. This provides for rapid and effective deployment.

What has been described then is an improved folding wing assembly using a flexible cover which allows for a less complex operational configuration, reduced weight and volume considerations, variable sweep angle control, and a higher Aspect Ratio.

The previous description of the preferred embodiments are provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiment shown herein, but is to be accorded the widest scope consistent with the principles and features disclosed herein.

What is claimed is:

1. A folding wing structure for use on missiles or airborne munitions which have an air frame surrounded by a housing, said wing structure comprising:

a leading edge spar pivotally mounted on a first end to said air frame a predetermined distance inside of said housing, said leading edge spar being pivotable between a retracted position with said leading edge spar being enclosed inside of said housing and a deployed position with a substantial portion of said leading edge spar extending outside of said housing at a predetermined sweep angle;

a trailing edge spar pivotally mounted on a first end to said air frame further inside of said housing than said leading edge spar, said trailing edge spar being pivotable between a retracted position with said trailing edge spar being enclosed inside of said housing and a deployed position with a substantial portion of said trailing edge spar extending outside of said housing at said sweep angle, said first end being spaced apart from said leading edge spar first end by a distance corresponding to a predetermined width for the wing structure when in a deployed position;

a plurality of cross ribs pivotally mounted in a substantially parallel manner between said leading edge spar and said trailing edge spar to extend therebetween so as to form a series of parallelograms with said spars;

a flexible cover disposed around and enveloping the folding structure formed by said leading and trailing edge spars and cross ribs;

means for defining a recess in said housing positioned about said wing structure in a retracted position; and deployment means for automatically pivoting said leading edge spar to said erected position.

2. The folding wing structure of claim 1 further comprising at least one intermediate spar pivotally secured on a first end to said air frame, the intermediate spar first end being spaced apart from said leading and trailing edge spars, on a line projecting between the first ends of said leading and trailing edge spars, being pivotable between a retracted position inside of said housing and an erected position outside of said housing and being pivotally connected to said cross ribs at intermediate positions so as to pivot with said leading and trailing edge spars and cross ribs.

3. The folding wing structure of claim 1 wherein said deployment means comprises spring means connected to said leading edge spar and said air frame for pivoting said leading edge spar to said erected position.

4. The folding wing structure of claim 1 wherein said leading edge and trailing edge spars each comprise tubular material having a diameter corresponding to a predetermined wing structure thickness and said ribs comprise a plurality of flat bars secured within the diameters of said leading and trailing edge spars.

5. The folding wing structure of claim 1 wherein said leading and trailing edge spars each comprise bar-shaped material and said ribs comprise a plurality of pairs of rectangular plates positioned on opposite sides of said spars.

6. The folding wing structure of claim 5 wherein at least one plate in each of said pairs of rectangular plates has an arcuate shape in a direction transverse to a plane containing said leading and trailing edge spars so as to form an airfoil shape when covered by said flexible covering.

7. The folding wing structure of claim 1 further comprising sweep angle control means for positioning said folding wing structure at a desired sweep angle.

8. The folding wing structure of claim 7 wherein said sweep angle defines a high Aspect Ratio wing structure.

9. The folding wing structure of claim 7 wherein said sweep angle control means comprises a detent disposed in at least one of said spars adjacent to a pivot point for one of said cross ribs and stop means mounted on said one cross rib adjacent said pivot point and positioned to engage said detent when said wing is deployed to a desired sweep angle.

10. The folding wing structure of claim 7 wherein said sweep control means further comprises:

lever means pivotally connected to said leading edge spar for altering a relative angular position of said leading edge spar with respect to said housing; and driver means connected to said lever means for moving said lever between a first position defining the retracted position on said leading edge spar and a plurality of second positions defining deployed wing structure positions in response to changing aerodynamic characteristics of said missile.

11. The folding wing of claim 1 wherein said sweep angle is less than ninety degrees.

12. A folding wing structure for use on missiles or airborne munitions, comprising:

an air frame having a housing;

a leading edge spar pivotally mounted on a first end to said air frame a predetermined distance inside of said housing, said leading edge spar being pivotable between a retracted position with said leading spar edge being enclosed inside of said housing and a deployed position with a substantial portion of said leading edge spar extending outside of said housing at a predetermined sweep angle less than ninety degrees;

a trailing edge spar pivotally mounted on a first end to said air frame further inside of said housing than said leading edge spar, said trailing edge spar being pivotable between a retracted position with said trailing edge spar being enclosed inside of said housing and a deployed position with a substantial portion of said trailing edge spar extending outside of said housing at said sweep angle, said first end being spaced apart from said leading edge spar first end by a distance corresponding to a predetermined wing width; and a plurality of cross ribs mounted between said leading edge spar and said trailing edge spar in a substantially parallel spaced apart relationship, each rib pivotally attached at a first end to said leading edge spar and at a second end to said trailing edge spar to extend therebetween so as to form with the other ribs a series of parallelograms with said leading and trailing edge spars in the wing structure.

* * * * *